US010308426B2

(12) United States Patent
Castro

(10) Patent No.: US 10,308,426 B2
(45) Date of Patent: Jun. 4, 2019

(54) TRASH BAG APPARATUS

(71) Applicant: Deja S. Castro, Menifee, CA (US)

(72) Inventor: Deja S. Castro, Menifee, CA (US)

( * ) Notice: Subject to any disclaimer, the term of this patent is extended or adjusted under 35 U.S.C. 154(b) by 0 days.

(21) Appl. No.: 15/193,972

(22) Filed: Jun. 27, 2016

(65) Prior Publication Data

US 2016/0304276 A1 Oct. 20, 2016

Related U.S. Application Data

(60) Provisional application No. 62/251,159, filed on Nov. 5, 2015.

(51) Int. Cl.

| | |
|---|---|
| ***A47F 9/04*** | (2006.01) |
| ***B65F 1/06*** | (2006.01) |
| ***B65F 1/14*** | (2006.01) |
| ***A47F 13/08*** | (2006.01) |

(52) U.S. Cl.

CPC ..... *B65F 1/1415* (2013.01); *A47F 9/042* (2013.01); *A47F 13/085* (2013.01); *B65F 1/062* (2013.01)

(58) Field of Classification Search

CPC ..... B65F 1/1415; B65F 1/062; B65F 1/141; B65F 1/0006; B65F 1/14; B65F 1/1426; B65D 33/001; B65D 33/007; B65D 33/14; B65D 77/30; B65D 83/0805; B65D 33/004; B65B 67/12; B65B 67/1238; B65B 67/04; A47F 13/085; A47F 9/042; A47F 5/0006; A47G 23/0258

USPC ..... 211/85.15, 12; 206/554; 248/95, 97, 248/99–101; 383/9, 37

See application file for complete search history.

(56) References Cited

U.S. PATENT DOCUMENTS

| | | | | |
|---|---|---|---|---|
| 3,556,395 A | | 1/1971 | Herman | |
| 3,603,542 A | | 9/1971 | Michael | |
| 3,638,888 A | | 2/1972 | Ross | |
| 3,655,157 A | | 4/1972 | Dalton | |
| 3,695,565 A | | 10/1972 | John | |
| 3,888,442 A | | 6/1975 | Comeaux | |
| 4,040,644 A | | 8/1977 | Flagg | |
| 4,046,257 A | * | 9/1977 | Lehmacher | B29C 65/18 206/544 |
| 4,216,863 A | * | 8/1980 | Seymour-Smith | B65D 75/5833 206/526 |
| 4,366,916 A | * | 1/1983 | Guido | B65D 5/42 206/554 |
| 4,487,318 A | * | 12/1984 | Roen | B65D 83/0805 206/494 |
| 4,537,330 A | * | 8/1985 | Gelbard | B65D 33/001 221/26 |
| 4,590,610 A | | 5/1986 | Rhyne | |

(Continued)

FOREIGN PATENT DOCUMENTS

WO 2005101242 A2 10/2005

*Primary Examiner* — Jennifer E. Novosad

(74) *Attorney, Agent, or Firm* — The Law Firm of Andrea Hence Evans, LLC

(57) ABSTRACT

A trash bag apparatus for trash bags having a main body, front and rear panels, detachable cutout sections that may be perforated and a flip section that provides a user access to the trash bags within the trash bag apparatus. The detachable cutout sections, when detached, enable dispensing of trash bags from the apparatus. The trash bag apparatus also contemplates a number of mounting holes that align with the holes of trash bags and bars or mounting structures of trash bag receptacles.

1 Claim, 16 Drawing Sheets

(56) References Cited

U.S. PATENT DOCUMENTS 4,669,251 A * 6/1987 Inagaki ..... B65D 33/14 206/554
4,805,800 A 2/1989 Nocek et al.
4,896,853 A 1/1990 Nyzen
4,998,694 A 3/1991 Barteaux
5,038,946 A * 8/1991 Tenser ..... A47F 5/04 206/554
5,188,235 A 2/1993 Pierce et al.
5,368,165 A * 11/1994 Ngyuen ..... B65D 83/0852 206/494
5,419,437 A * 5/1995 Huseman ..... B65B 43/26 206/554
5,509,570 A * 4/1996 DeMatteis ..... B65D 83/08 221/303
5,584,402 A * 12/1996 Johnson ..... A47F 9/042 206/554
5,639,051 A * 6/1997 Surbeck ..... B65B 67/1216 248/100
5,655,682 A * 8/1997 Hoffrichter ..... B65D 83/0805 206/554
5,688,394 A * 11/1997 McBride, Jr. ..... B65D 83/0805 134/40
5,695,065 A * 12/1997 Kennedy ..... B65D 83/0876 206/494
5,788,080 A * 8/1998 Sill ..... B65D 33/2508 206/554
5,826,724 A * 10/1998 Gebhardt ..... B65D 33/001 206/554
5,927,660 A * 7/1999 McNerney ..... A47F 13/085 206/554
6,098,806 A * 8/2000 Mills ..... B65D 33/001 206/494
6,116,424 A * 9/2000 Leu ..... B65D 33/001 206/554
6,142,302 A * 11/2000 Requena ..... B65D 33/001 206/554
6,237,878 B1 5/2001 Nelson
6,286,680 B1 * 9/2001 Hofrichter ..... B65D 33/001 206/554
6,401,971 B1 * 6/2002 Edwards ..... B65D 5/5007 221/26
6,454,125 B1 * 9/2002 Rink, Jr. ..... A41D 3/08 206/554
6,478,156 B1 * 11/2002 Gebhardt ..... B65D 33/001 206/554
6,497,340 B2 * 12/2002 Grinberg ..... A41D 19/0072 2/158
6,557,723 B2 * 5/2003 Chen ..... A47F 13/085 206/554
6,571,984 B1 * 6/2003 Winesett ..... B65D 83/0805 206/554
6,619,479 B2 * 9/2003 Jones ..... A47F 9/042 206/554
6,655,546 B1 * 12/2003 Bolton ..... B65D 83/0847 206/554
6,772,909 B2 * 8/2004 Bateman ..... A47F 9/042 206/554
7,175,025 B2 * 2/2007 Chum ..... B65D 83/0847 206/449
7,458,600 B1 12/2008 Berke et al.
7,654,443 B1 2/2010 Fuller et al.
8,210,354 B2 * 7/2012 Alvarado ..... A47F 13/085 206/554
D696,107 S * 12/2013 Kimple ..... D9/416
8,851,316 B2 * 10/2014 Barrett ..... B65F 1/062 206/389
8,960,493 B1 * 2/2015 Dennison ..... A47G 25/904 2/159
9,038,819 B2 * 5/2015 Perelli ..... B67D 7/0288 206/205
9,265,364 B2 * 2/2016 Tan ..... A47F 9/042
2005/0047685 A1 * 3/2005 Tsutsumi ..... B65D 33/001 383/8
2005/0121351 A1 * 6/2005 Dickinson ..... B65D 33/001 206/554
2007/0235600 A1 10/2007 Herold et al.
2008/0035522 A1 * 2/2008 Tan ..... B65D 33/007 206/554
2008/0257778 A1 * 10/2008 Dickinson ..... B65D 33/001 206/554
2008/0303301 A1 12/2008 Startzell et al.
2010/0067831 A1 3/2010 Alvarado et al.
2010/0276428 A1 11/2010 Lord et al.
2016/0001973 A1 * 1/2016 Castro ..... B65F 1/1415 220/571
2016/0304276 A1 * 10/2016 Castro ..... B65F 1/062

* cited by examiner

TRASH BAG APPARATUS

CROSS-REFERENCE TO RELATED APPLICATIONS

This Application claims the benefit of, and is related to, the following Applicant's provisional patent application: U.S. Provisional Patent Application No. 62/251,159 titled "Trash Bag Apparatus" filed Nov. 5, 2015, which is incorporated herein in its entirety.

FIELD OF THE INVENTION

The present invention relates, in general, to a bag apparatus for the storage and dispensing of bags where the apparatus is structurally and functionally configured to be used in conjunction with bag receptacles that use bars/rods to mount and dispense bags.

BACKGROUND OF THE INVENTION

Certain trash receptacles use specific structures such as bars/rods in order to dispense garbage bags. Current bag apparatus or containers for bags do not have the requisite structure and/or features needed to effectively dispense trash bags in conjunction with the trash receptacles that use bars/rods. Current bag containers also are not adequately structured to position bags in a ready to use position as they require a user to first remove the bag, open it and then place the bag in a secure ready to use position. As such, there exists a need for a trash bag apparatus or storage apparatus that can perform the functions required by trash receptacles with mounting bars/rods and trash receptacles that require trash bags with parallel holes punched or made in them. There also exists a need for a trash bag apparatus that ensures that the trash bags are in a ready position for immediate deployment once the apparatus is mounted onto trash bag receptacles that have mounting bars/rods.

SUMMARY OF THE INVENTION

An aspect of an embodiment of the present invention contemplates a trash bag apparatus that may include a main body, the main body having two parallel holes compatible for use with a trash receptacle that uses bars/rods/wire, or mounting structures to hang bags on (all meaning the same thing being interchangable) to dispense trash bags. The trash bag apparatus or container may also include detachable, and/or perforated opening(s)/cutout(s) that enable a user to detach the cutout(s) or openings and gain access to the trash bags. The trash bag apparatus may also include a flip at the top of the container (which enables user access to the trash bags from the top), front and rear panels. The present invention is also able to be used with all types of receptacles and for other purposes with plastic bags such as packaging things or produce, to name a few. The apparatus described herein can be any sort of container that would hold the contents, including without limitations a box or other packaging device.

In an aspect of an embodiment of the present invention, a first detachable and/or perforated cutout/opening may be located on the trash bag apparatus's or container's front panel. In another aspect of an embodiment of the present invention, this cutout/opening may also have detachable and/or perforated sections around the parallel holes for the trash receptacle's bag mounting bars/rods to have access to enter in and pass through the apparatus.

In an aspect of an embodiment of the present invention, the trash bag apparatus may include a second detachable and/or perforated section located in the front panel that is larger than the first detachable section.

In an aspect of an embodiment of the present invention, the second detachable and/or perforated section may have two sides which may also be perforated and/or detachable in order to allow for a wider area to enable a user to easily detach a trash bag.

In an aspect of an embodiment of the present invention, the apparatus may include a large detachable and/or perforated section. The large detachable and/or perforated cutout/opening or section may be located on the trash bag apparatus's or container's front panel. In another aspect of an embodiment of the present invention, this large cutout/opening may also have perforated sections around the parallel holes for the trash receptacle's bag mounting bars/rods.

In an aspect of an embodiment of the present invention, the first detachable and/or perforated section may have two sides which may also be perforated and/or detachable in order to allow for a wider area to be open to enable a user to easily deploy a trash bag.

In an aspect of an embodiment of the present invention, the trash bag apparatus may include a large perforated section which may cover a large area of the front panel.

In an aspect of an embodiment of the present invention, the trash bag apparatus may include attachment mechanism(s) meant to attach or secure the apparatus to the trash bag receptacle.

Another aspect of an embodiment of the present invention contemplates an apparatus that is structurally and/or functionally configured to enable a user to safely transport the apparatus, load the apparatus on the mounting bars/rods, and use the apparatus having a large stack of bags without concern of the bags falling or becoming unusable if they become misaligned with the trash receptacle mounting bars/rods.

An aspect of an embodiment of the present invention contemplates a set of two strategically located parallel holes in the front and back of the apparatus that align front to back. Certain aspects of embodiments of the present invention contemplate a variety of shapes for these holes, including, without limitation, round holes, square holes etc. The holes are configured to be compatible with the trash receptacle bars/rods and the bag's hanging holes that are packaged inside of the apparatus.

In an aspect of an embodiment of the present invention, the apparatus may include an area that is open on the front and the back like a large rectangle or any shape that would allow the two parallel holes of the bag to be exposed from one large cutout/opening area of the bag apparatus. The area may be detachable and/or perforated or left open by the manufacturer. The open area on the front panel would allow the loading of the apparatus onto the bars/rods/wires of the receptacle and also allow the bags to be dispensed through the same opening. Aspects of embodiments of the present invention contemplate either a large open section all in one or two parallel openings with an additional opening for the bags to exit the apparatus and ride along the bars/rods, in which case, either way the holes are accessible for loading onto the bars/rods.

In another aspect of an embodiment of the present invention, access for the receptacle bars/rods may be made by a hole or holes on the front and the back of the apparatus which may be perforated areas or structurally weakened areas that can be easily removed or enable the bars/rods to easily puncture or enter through the holes when a user is ready to hang the apparatus. In another aspect of an embodiment of the present invention, these bar/rod access area(s) of the apparatus may be removed by the apparatus manufacturer and sold open.

In another aspect of an embodiment of the present invention, the apparatus may be structurally and/or functionally configured to allow plastic bags to be loaded into the apparatus and adjusted so the bags' parallel punched holes end up exactly aligned with the hole(s) in the front and back of the apparatus.

A further aspect of an embodiment of the present invention contemplates a trash bag apparatus which may include front and rear panels, two parallel holes compatible for use with a trash receptacle that uses bars/rods to dispense trash bags, where the holes may extend through, and align with, both front and rear panels and mounting holes of the bags thereby enabling mounting of the apparatus and the bags within onto bars/rods of a bag receptacle. The bag apparatus may also include a detachable, slim section of the front panel, where the slim section enables a user to detach the slim section to deploy a bag from the apparatus, and a detachable top section at the top of the apparatus, where the top section, upon removal, enables user access to the hanging holes of the bags.

In a further aspect of an embodiment of the present invention, the bag apparatus may also include a detachable medium section that is larger than the slim detachable section of the front panel, where the medium section enables faster bag deployment from the apparatus than the slim section did.

In a further aspect of an embodiment of the present invention, the bag apparatus may also include a detachable large section that is bigger than the medium section of the front panel, where the large section enables even faster bag deployment from the apparatus than the medium section would allow.

In a further aspect of an embodiment of the present invention, the detachable top section may include both detachable and non-detachable sections, where the non-detachable section enables the apparatus to remain mounted on the bars/rods (of the receptacle) after the detachable section of the top section has been detached. In another aspect of an embodiment of the present invention, the non-detachable section may be located at the rear of the top section.

In an aspect of an embodiment of the present invention, the single large section or parallel holes/openings may be located on the bag apparatus in the front and back and in an area towards the top of the bag apparatus. This configuration or positioning will allow access by hanging bars/rods of a receptacle which may then be able to enter the rear hole(s) of the bag apparatus then at the same time enter into the bag's hanging holes that are inside the bag apparatus and then pass through the front opening of the bag apparatus so the bars/rods pass through and remain inside the bags and the bag apparatus all at once.

In an aspect of an embodiment of the present invention, the bag apparatus may be structurally and/or functionally configured to allow bags to be in a position that works with a two parallel bar/rod/wire receptacle system. The bag apparatus may also be structurally and/or functionally configured to enable bags to be upright, with the open bag mouth on top, the closed area at the bottom and be stacked in an order where the back of the first bag signals or effects the front of the second bag to open when the first is removed from the bag apparatus although any type of bag may be used with this bag apparatus.

In another aspect of an embodiment of the present invention, the bag apparatus may be firm enough to keep the bags tight and orderly. Use of strong cardboard material, for instance, may suffice. Plastic material may also be used. However, these examples are not limiting as other strong materials may be used in order to meet the demands of the apparatus as disclosed in this application. Aspects of embodiments of the present invention also contemplate the bag apparatus being made of different material.

In another aspect of an embodiment of the present invention, the bag apparatus may be structurally and/or functionally configured to exert enough force on the stack of trash bags so that only one bag is removed at a time. This saves money for the user as there will be fewer wasted bags and less frustration for the user.

Another aspect of an embodiment of the present invention contemplates a trash bag apparatus that is free hanging so the bottom of the apparatus is not touching the base of the trash receptacle or the floor so that the trash bag apparatus remains clean to protect the trash bags inside the trash bag apparatus from being soiled if a used bag leaks.

Another aspect of an embodiment of the present invention contemplates a trash bag apparatus with the ability to be enclosed during shipment, storing, sales, etc. so the trash bags within it remain protected, clean and orderly.

Another aspect of an embodiment of the present invention contemplates a trash bag apparatus with one or more openings in the front and one or more openings on the back towards the top area of the apparatus that allows the user to see the parallel holes of the bags through those openings on the apparatus in order to place the rods/bars through one side of the apparatus into the holes of the bags and out the other side of the apparatus in order to load the entire apparatus with bags inside of it onto the rods/bars. The opening(s) in the top area of the front and back panels of the apparatus can be left open by the manufacturer on purpose or made to be purposely removed by the manufacturer or the user at some point.

The trash bag apparatus may have a number of precut, outlined, adhesively stuck on, or weakened areas that may removable by perforation, tearing, peeling or cutting or any other means in the front panel of the apparatus from which the bags will be dispensed from.

The trash bag apparatus may have one or more openings in the front of the apparatus where the bags can exit while still hanging on the bars/rods from inside the apparatus and move along the bars/rods into the ready to use position so they can collect trash while still hanging. The one or more openings that are in the front panel of the apparatus for the bags to exit the apparatus through can be left open completely or partially on purpose by the manufacturer or designed to be removed by the manufacturer or user. If the front panel opening is designed to stay open any type of material can be used to keep the bags inside until ready to use such as a sticker that peels off etc.

An aspect of an embodiment of the present invention contemplates the trash bag apparatus being enabled structurally to allow rear parallel holes or one larger open section to access the bags hanging holes. The parallel holes may remain so that the trash bag apparatus may be hung and support the interior bags. However, the front holes of the trash bag apparatus will end up being removed with sections of the front panel so the bag will not be prevented from exiting the apparatus and can freely move along the rods while exiting the trash bag apparatus when needed.

Aspects of embodiments of the present invention contemplate the trash bag apparatus can have a few options of different shapes and sizes of front panel cut out/open areas so the user can decide how easy and speedily they would like to adjust the bag removal quality.

Aspects of embodiments of the present invention contemplate the trash bag apparatus having already one or more open or precut or optionally removable sections on the back panel of the apparatus similar to those on the front panel in case the apparatus is loaded backwards and so the user does not have to remove and reload it in the correct direction.

In a further aspect of an embodiment of the present invention the trash bag apparatus may include a detachable top section which covers the holes in the bags and when detached will allow the top section of the bags where the hanging holes are to completely be exposed and easily loaded onto the receptacle mounting bars/rods/wires.

In a further aspect of an embodiment of the present invention the trash bag apparatus may include a top section that keeps the middle and bottom sections so that the bags are still kept orderly.

The trash bag apparatus may have areas of the front panel material remaining in place after an open access area in the front panel has been made to dispense bags out of. The trash bag apparatus may also be structurally and/or functionally configured to allow pressure from the remaining front panel sections/areas to be applied to the interior bag stack so that the bags do not inconveniently come out of the apparatus through the open access area in the front panel that was made for dispensing bags.

Aspects of embodiment of the present invention contemplate attachment or securing mechanism(s) that enable the trash bag apparatus to be secured into place at the rear area of the bars/rods so it cannot easily move. Exemplary, but not limiting, examples of such attachment mechanism(s), include adhesives on the back of the trash bag apparatus or the receptacle, hook and loop, interlocking, hanging, hooks, clipping mechanisms (that clip the apparatus into position or engage into position with the receptacle itself or a part of the receptacle). The trash bag apparatus can connect on to the rod/bar system, the rear receptacle area, the rear cross bar, etc. depending on which two bar/rod/wire style of receptacle the user is using.

A further aspect of an embodiment of the present invention contemplates the trash bag apparatus being structurally and functionally configured to allow the last bag of the stack to be releasably secured to the inside of the back panel of the apparatus so that when the user is approaching the last few bags they do not fall out of the apparatus as a result of the bag not being secured or held back by pressure.

A further aspect of an embodiment of the present invention contemplates the trash bag apparatus maintaining the interior bag stacks hanging hole alignment by any number of methods, systems, etc.

A further aspect of an embodiment of the present invention contemplates the trash bag apparatus having a corking arrangement for the bag holes before being loaded for use while they are still in the apparatus.

A further aspect of an embodiment of the present invention contemplates the trash bag apparatus having a tying arrangement through the holes until use of the bags. The trash bag holes may stay in place simply from intense direct pressure from the trash bag apparatus itself. Any type of material or construction of the apparatus can be used to keep the bag hanging holes aligned and ready for mounting.

The bag apparatus allows for the smooth transition for a bag to go from folded, hanging, supported and protected while inside the apparatus to then be deployed from the apparatus for use while still hanging in a fully supported position by the bars/rods of the receptacle.

Additional aspects, objectives, features and advantages of the present invention will become apparent from the following description of the preferred embodiments with reference to the attached drawings.

DETAILED DESCRIPTION OF THE INVENTION

Referring now to FIGS. 1-5, views showing trash bag apparatus 1, its parallel holes 2A & 2B, front panel 3 of trash bag apparatus 1, trash bag apparatus 1's mounting onto trash receptacle bars/rods 5, and a detailed view of holes 2A, 2B of a trash bag apparatus are shown according to aspect(s) of embodiment(s) of the present invention.

Figure 29:
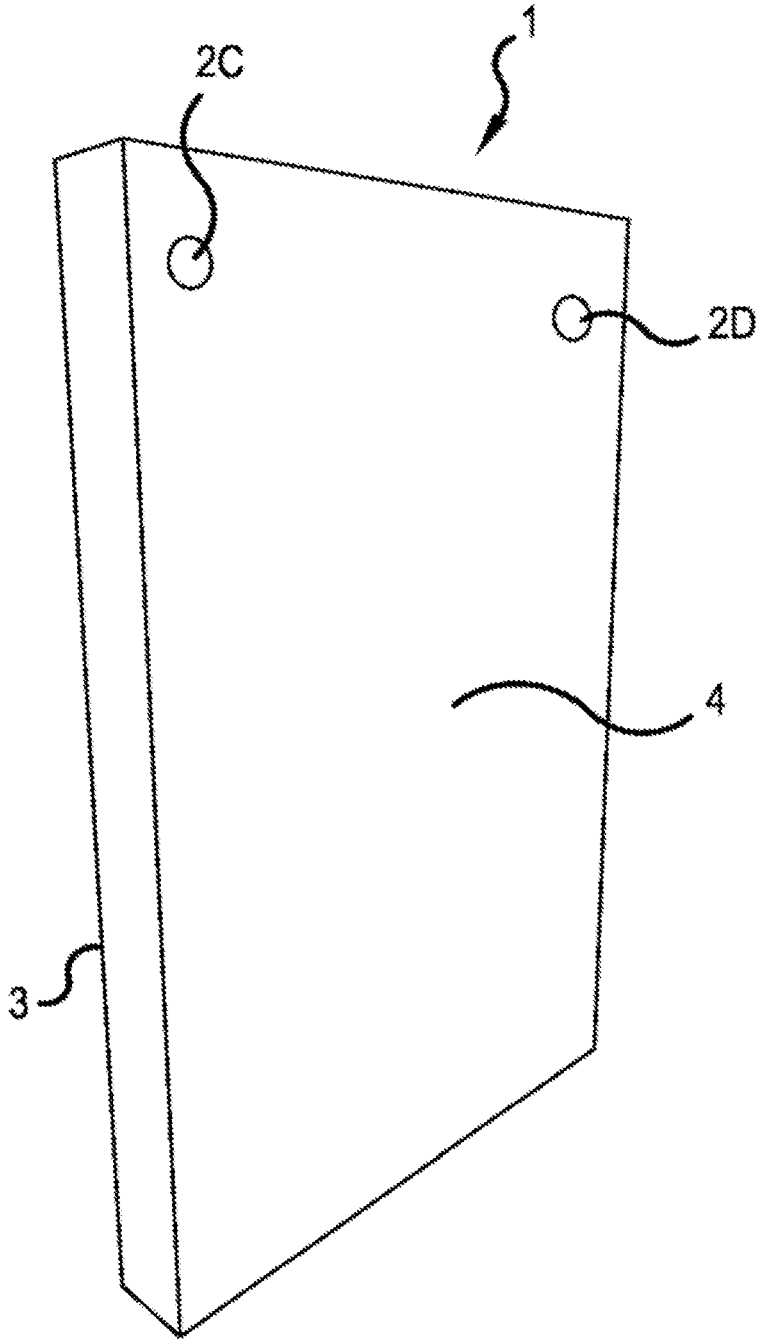
FIG. 29 illustrates a rear view showing a bag apparatus and parallel holes which enable mounting of the bag apparatus onto a trash receptacle according to an aspect of an embodiment of the present invention

Trash bag apparatus 1 is shown having parallel holes 2A and 2B on front panel 3 and holes 2C and 2D on rear panel 4, shown in FIG. 29, which are configured to be mounted onto a trash receptacle having bars/rods 5. Holes 2A-D of apparatus 1 are aligned from front to rear and extend from front panel 3 to back panel 4 of apparatus 1 and provide access while mounting on the trash receptacle rods/bars through the rear panel 4 into the interior product space of trash bag apparatus 1 and also through front panel 3. In an aspect of an embodiment of the present invention, front panel 3 may include one or more removable and/or perforated sections or cutouts 3A through 3C. In one aspect of an embodiment of the present invention, sections 3B and 3C may be semi-circular in shape and may be positioned on either side of outer detachable cutout 3A. In application, holes 2A-2B enable installation of bag apparatus 1 containing bag(s) 6 onto receptacle bars/rods 5. This may be made possible by holes 6A and 6B on bag(s) 6 which align with holes 2A-D of apparatus 1 which enable bars/rods 5 to enter through holes 2A-D, and holes 6A & 6B.

Figure 30:
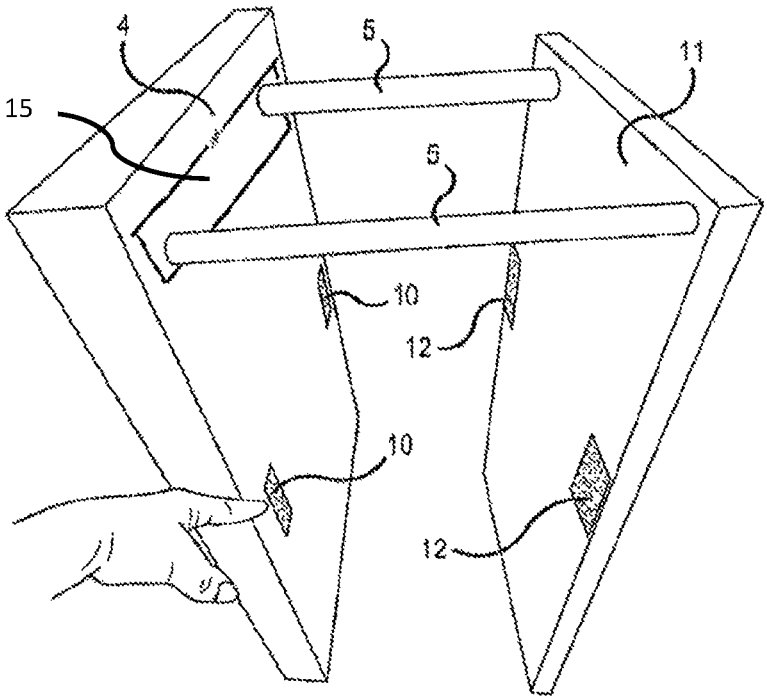
FIG. 30 illustrates a view showing a trash bag apparatus with attachment mechanism(s) having one rear opening, according to an aspect of an embodiment of the present invention.

As shown in FIG. 30, in an aspect of an embodiment of the present invention, the apparatus may include a large area 15 that is open on the back like a large rectangle that would allow the two parallel holes to be exposed from one large cutout area of the trash bag apparatus. The large area may be detachably perforated.

Parallel holes 2A-D of bag apparatus 1 may be multipurpose in function to perform, inter alia, the following functions:

1. Enabling the loading of bag apparatus 1 onto rod(s) or bar(s) 5 of receptacle 11 thereby hanging bag apparatus 1 for use;
2. Keeping the holes in bag(s) 6 in positioned alignment; and
3. Allowing bag(s) 6 to deploy from inside bag apparatus 1 directly into the ready to use position while keeping alignment with receptacle bar(s)/rod(s) 5.

In an aspect of an embodiment of the present invention, front panel 3 may include first and second removable or detachable sections where the second section may be larger than the first section and where both sections enable a user to remove or detach either section to gain access to the trash bags.

In another aspect of an embodiment of the present invention, front panel 3 may include opening(s) compatible for use with a receptacle that uses bars or rods 5 to dispense bags 6, where the openings extend through and align with both front (3) and rear (4) panels with mounting holes 2A-D and mounting holes 6A and 6B of bags 6 thereby enabling mounting of apparatus 1 and bags 6 onto bars or rods 5. Front panel 3 may also have opening(s) where the opening(s) enables a user to deploy trash bag 6 from apparatus 1. In one aspect, the opening(s) in front panel 3 for bag deployment may be manufactured to remain open. In another aspect, the opening(s) in front panel 3 may be temporarily closed and ready to open by being removed or detached when ready to use. In yet another aspect, the opening(s) in front panel 3 for bag deployment may be temporarily covered or closed by any material until ready to use.

Figure 1:
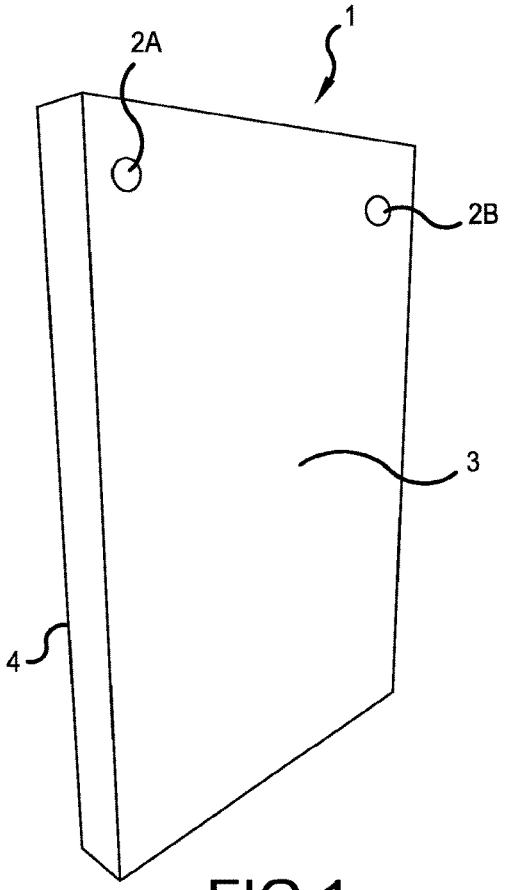
FIG. 1 illustrates a view showing a bag apparatus and parallel holes which enable mounting of the bag apparatus onto a trash receptacle according to an aspect of an embodiment of the present invention.
Figure 2:
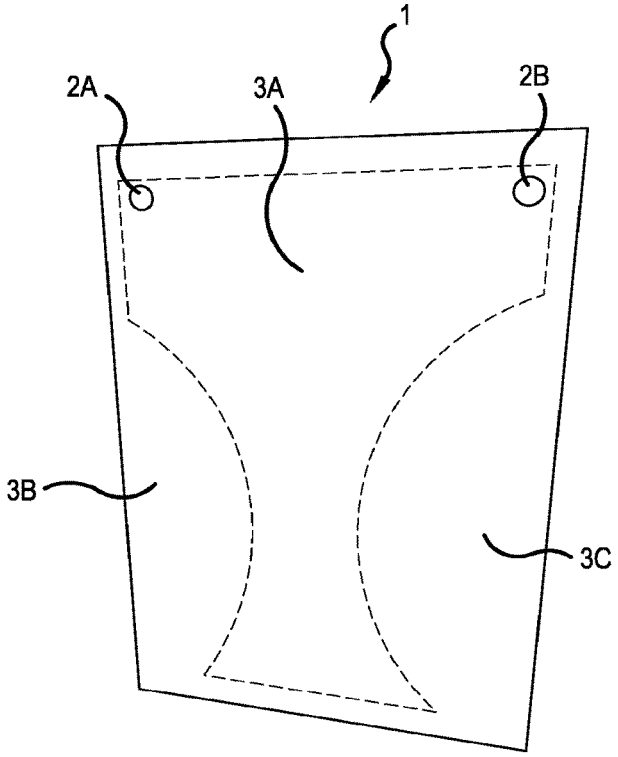
FIG. 2 illustrates a view showing a bag apparatus and a detachable and/or perforated section on a front panel of the bag apparatus according to an aspect of an embodiment of the present invention.
Figure 3:
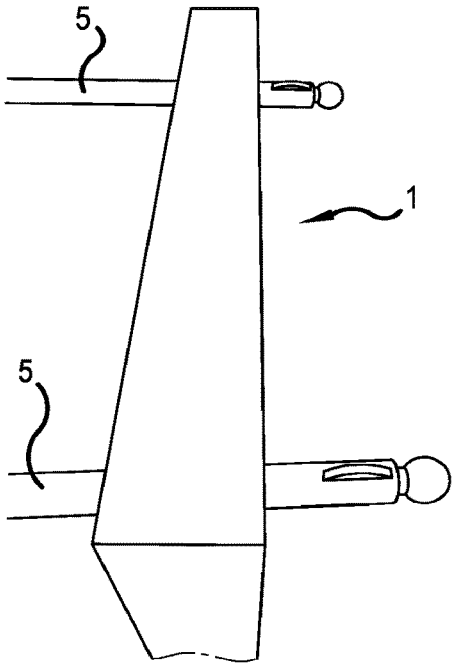
FIG. 3 illustrates a view showing a bag apparatus having been mounted onto the bars/rods of a receptacle according to an aspect of an embodiment of the present invention.
Figure 4:
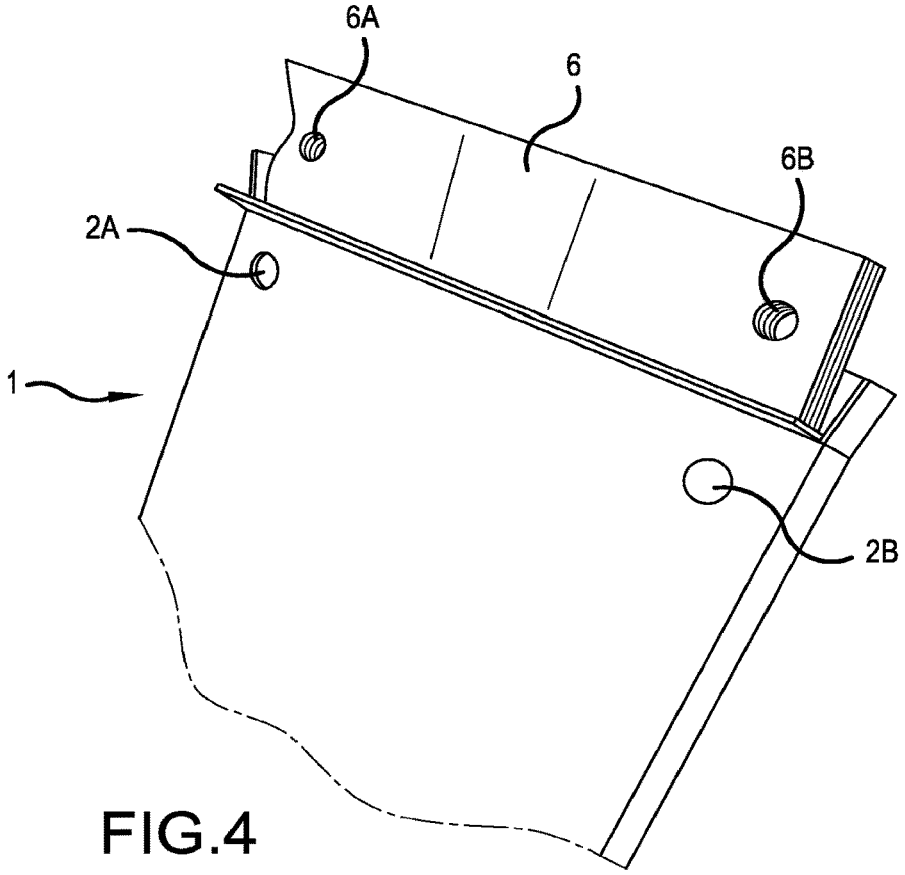
FIG. 4 illustrates a view showing trash bags with their holes in conjunction with a trash bag apparatus according to an aspect of an embodiment of the present invention.
Figure 5:
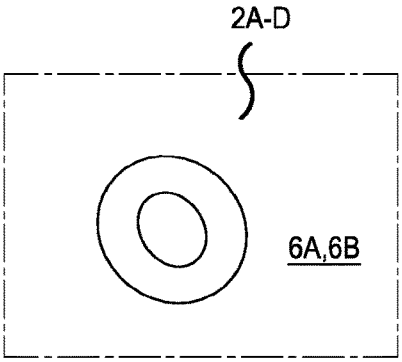
FIG. 5 illustrates a view showing a detailed view of an outer circle that represents the hole in a bag apparatus that aligns with an inner circle which represents the hanging holes of the bags that are inside of the apparatus so the hanging rods/bars of a receptacle can enter through both the apparatus hole and bags holes simultaneously according to an aspect of an embodiment of the present invention.
Figure 6:
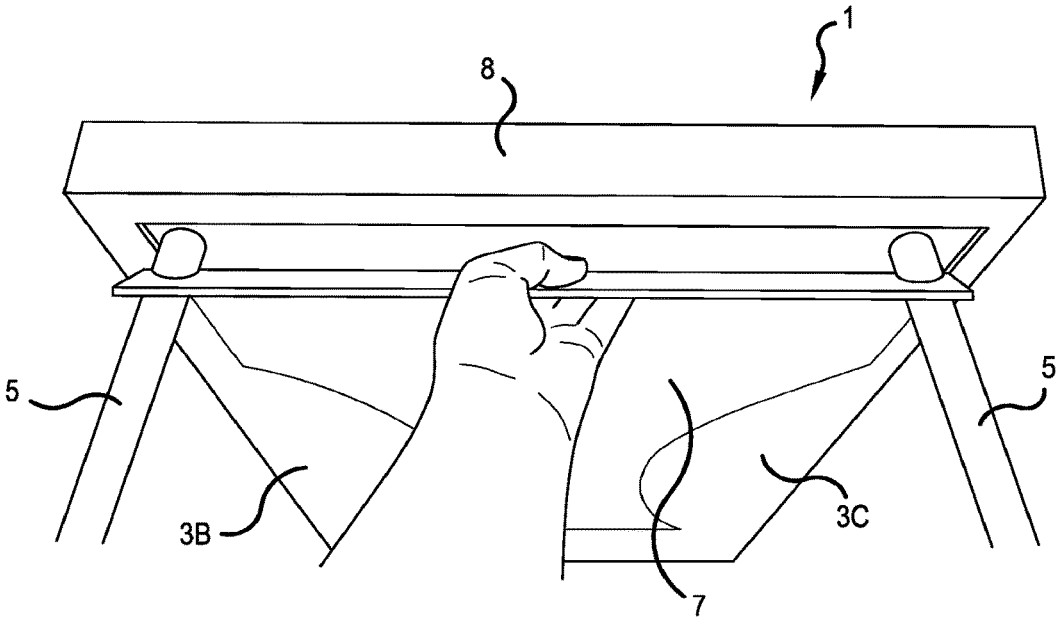
FIG. 6 illustrates a view showing a user beginning to remove a detachable and/or perforated section of a trash bag apparatus according to an aspect of an embodiment of the present invention.
Figure 7:
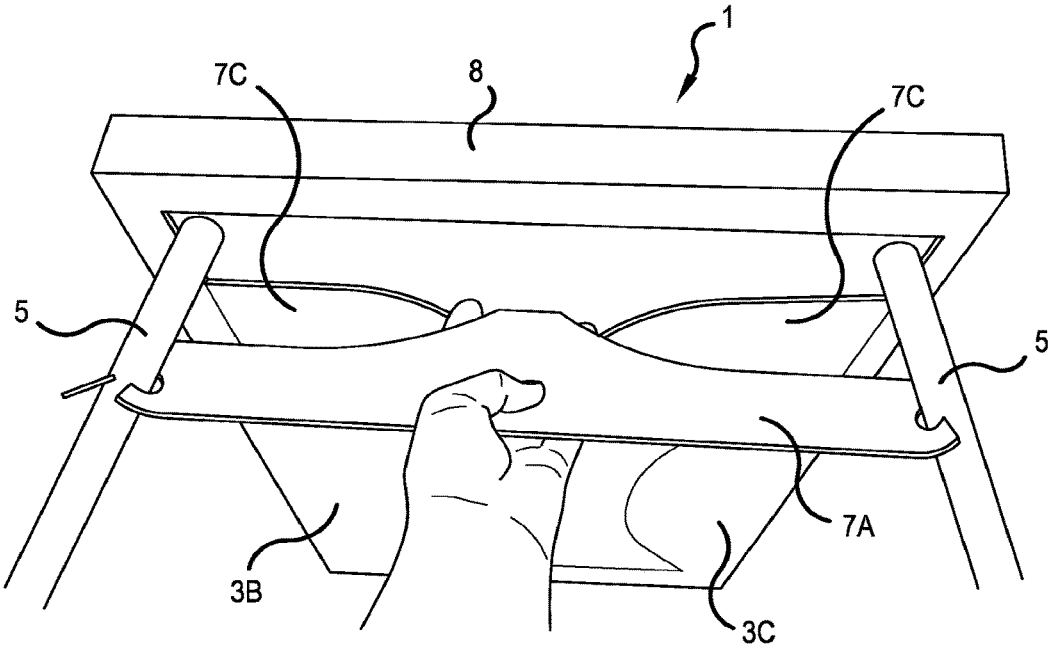
FIG. 7 illustrates a view showing a user continuing to remove a detachable and/or perforated section of a trash bag apparatus according to an aspect of an embodiment of the present invention.
Figure 8:
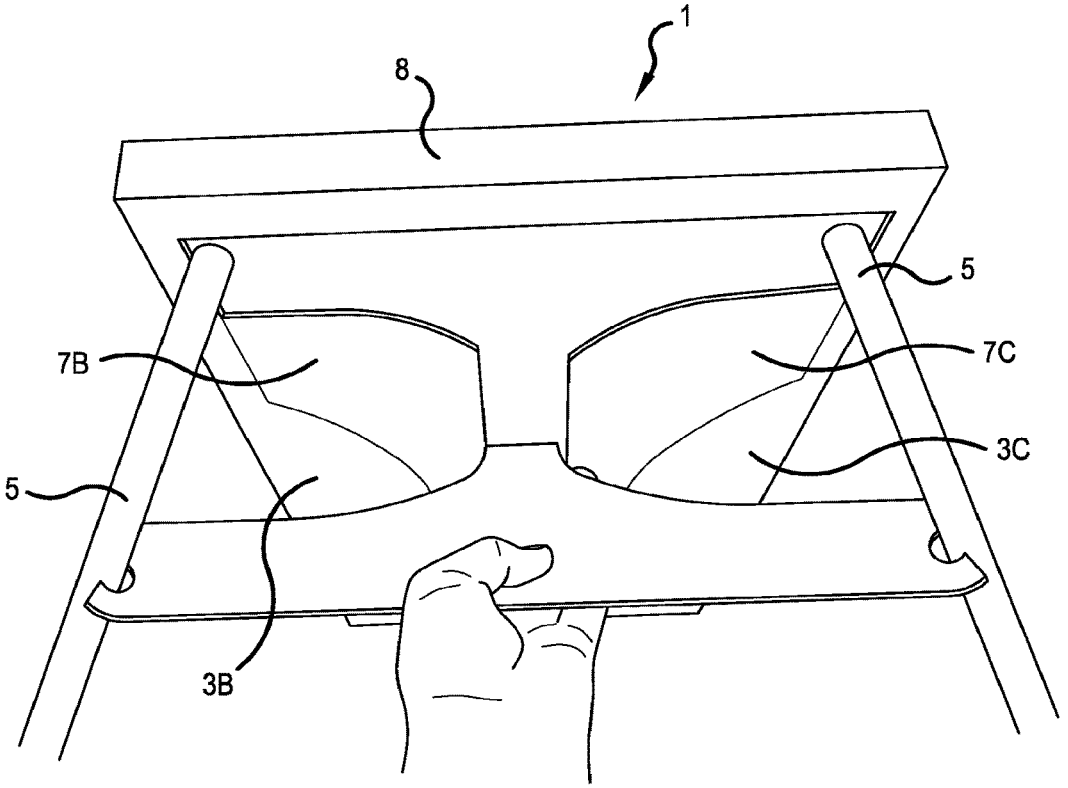
FIG. 8 illustrates a view showing a user further removing a detachable and/or perforated section of a trash bag apparatus according to an aspect of an embodiment of the present invention.
Figure 9:
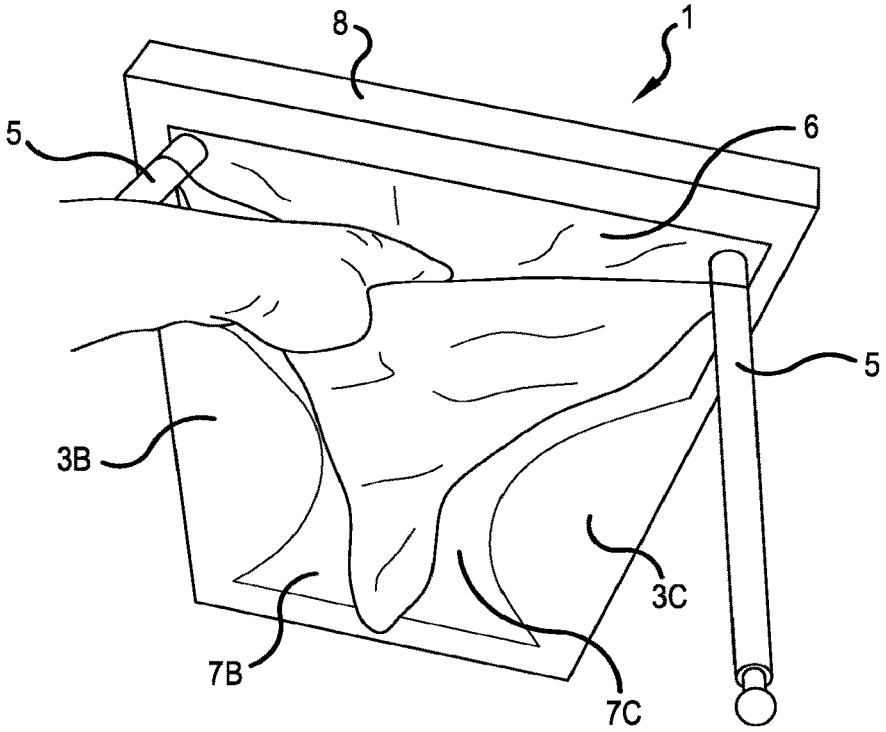
FIG. 9 illustrates a view showing a user dispensing a trash bag from a trash bag apparatus, the user having removed a detachable and/or perforated section of the trash bag apparatus according to an aspect of an embodiment of the present invention.

Referring now to FIGS. 6-9 views showing a user progressively removing or detaching inner removable and/or perforated section 7 of apparatus 1 are shown according to aspect(s) of embodiment(s) of the present invention. Inner removable and/or perforated cutout or section 7 may be exposed with the removal of outer removable or detachable cutout 3A. In one aspect of an embodiment of the present invention, section 7 may have three sections 7A-C with section 7A being located in the middle and sections 7B & 7C being located to the respective sides of section 7A. In one aspect of an embodiment of the present invention, section 7A may include a slim or first section which enables a tighter hold for slower bag deployment as shown in FIG. 9 with the slow deployment of bag 6 through the slim section of cutout 7A.

Figure 10:
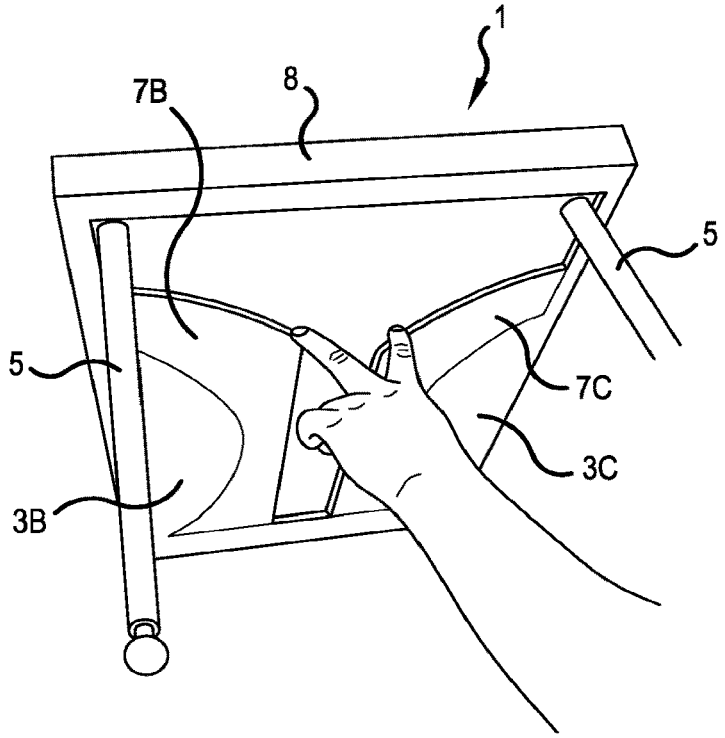
FIG. 10 illustrates a view showing a user beginning to remove additional sections of a detachable and/or perforated section of a trash bag apparatus according to an aspect of an embodiment of the present invention.
Figure 11:
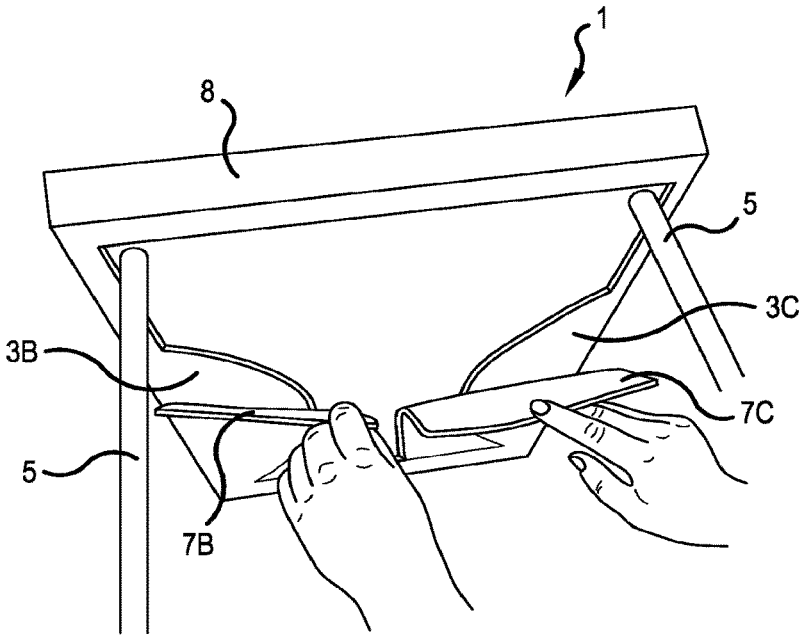
FIG. 11 illustrates a view showing a user continuing to remove additional sections of a detachable and/or perforated section of a trash bag apparatus according to an aspect of an embodiment of the present invention.
Figure 12:
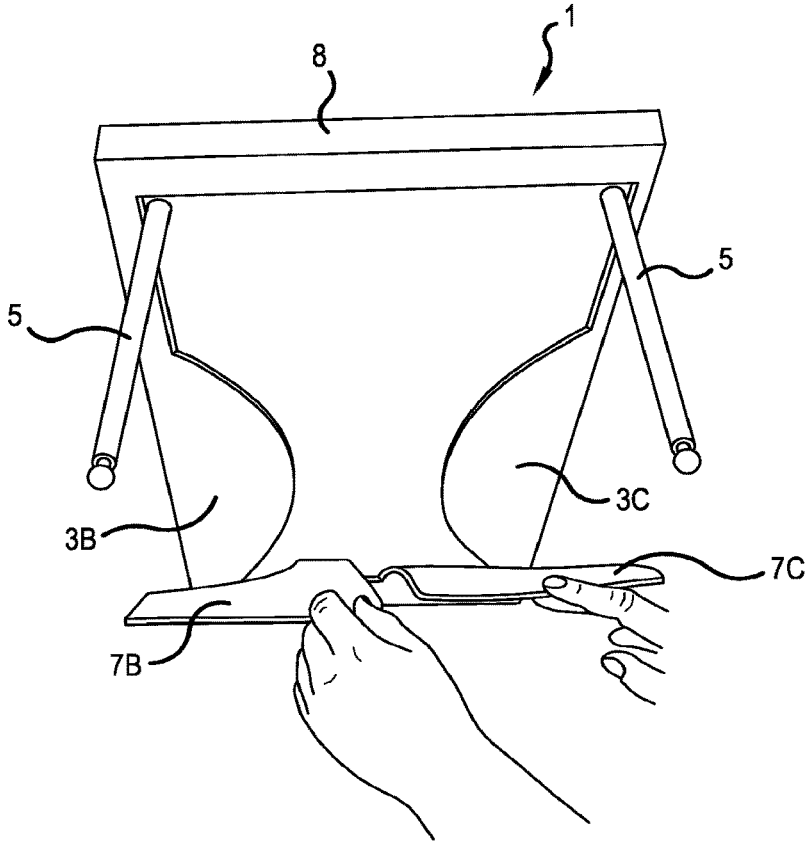
FIG. 12 illustrates a view showing a user further removing additional sections of a detachable and/or perforated section of a trash bag apparatus according to an aspect of an embodiment of the present invention.

Referring now to FIGS. 10-12 views showing a user removing or detaching additional or second sections 7B & 7C of inner removable and/or perforated section 7 of trash bag apparatus 1 are shown according to aspect(s) of embodiment(s) of the present invention. Removal of sections 7B & 7C enable faster and easier deployment of bag 6 from apparatus 1.

In a further aspect of an embodiment of the present invention, trash bag apparatus 1 may include a removable or detachable medium section located on the front panel 3, where the medium section enables faster trash bag 6 deployment from apparatus 1. In a yet further aspect of an embodiment of the present invention, trash bag apparatus 1 may also include a removable or detachable large or third section located on the front panel that is larger than the medium section, where the large section may enable even faster trash bag 6 deployment from apparatus 1.

Figure 13:
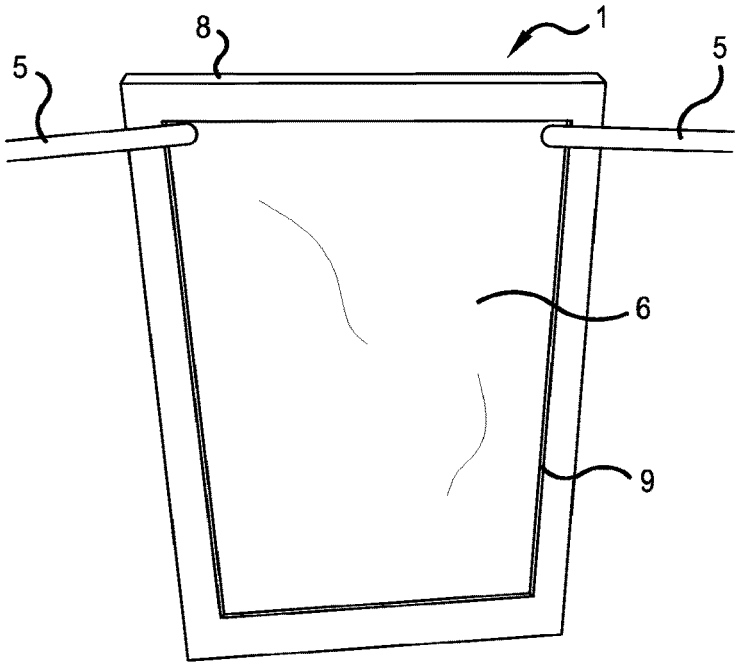
FIG. 13 illustrates a view showing a trash bag apparatus with an open section and mounted on a trash bag receptacle according to an aspect of an embodiment of the present invention.
Figure 14:
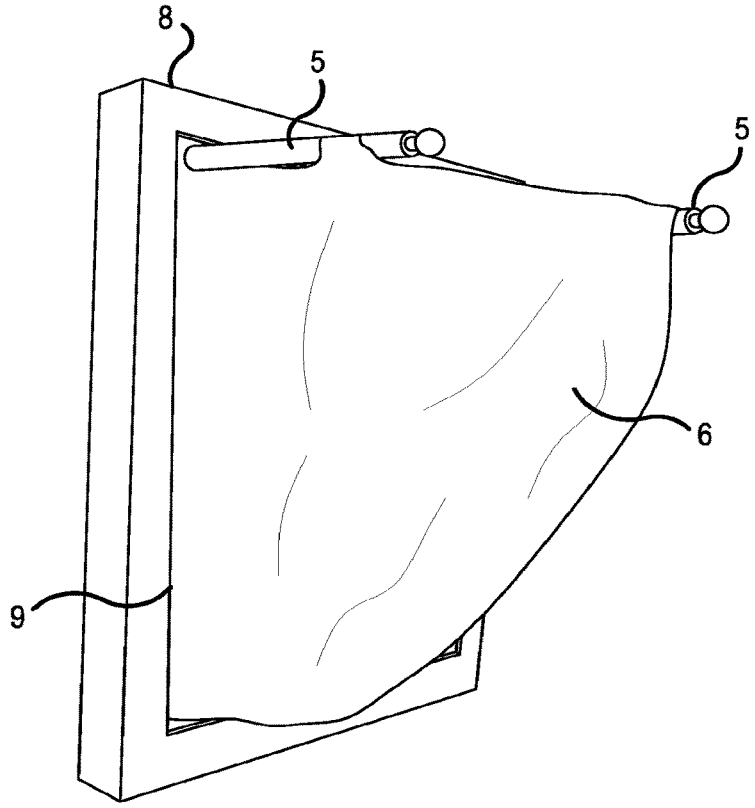
FIG. 14 illustrates a view showing a trash bag apparatus mounted on a trash bag receptacle with a dispensed trash bag according to an aspect of an embodiment of the present invention.

Referring now to FIGS. 13 and 14 views showing a mounted trash bag apparatus 1 having an open section 9 and a deployment view of bag 6 from apparatus 1 through open section 9 are shown according to aspect(s) of embodiment(s) of the present invention. In one aspect of an embodiment of the present invention, apparatus 1 may have one large removable and/or perforated front panel 3, which, upon removal provides open section 9 for faster and full deployment of bag 6 from apparatus 1 as shown in FIG. 14.

Figure 15:
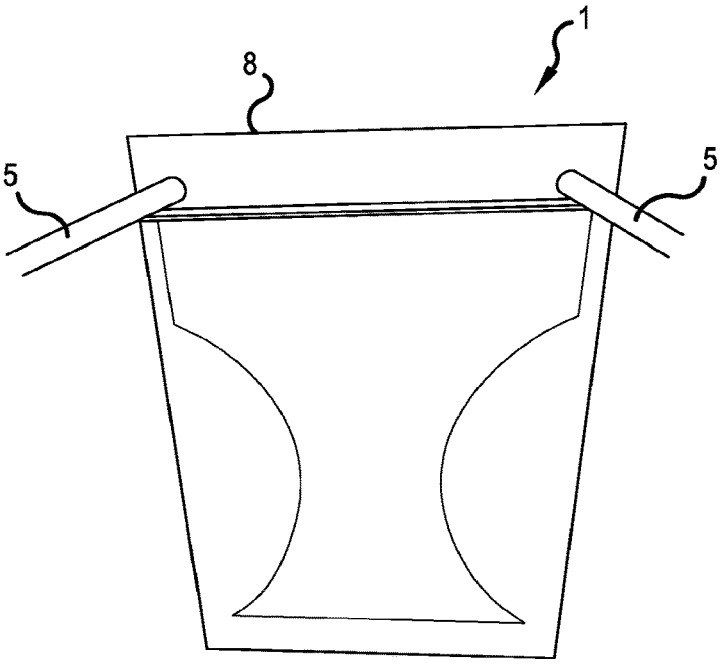
FIG. 15 illustrates a view showing a trash bag apparatus mounted on a trash bag receptacle showing a removable/detachable top section of the trash bag apparatus according to an aspect of an embodiment of the present invention.
Figure 16:
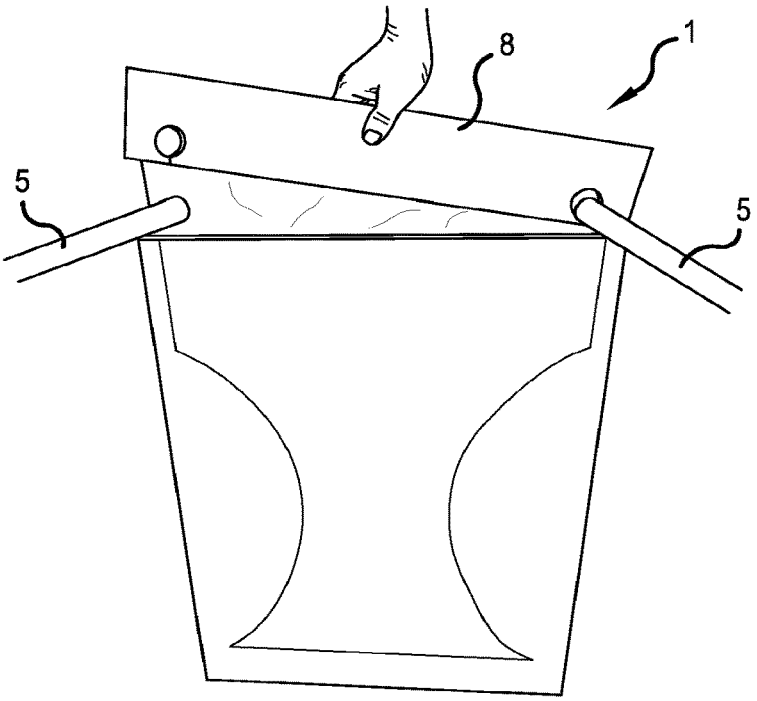
FIG. 16 illustrates a view showing a trash bag apparatus mounted on a trash bag receptacle showing its removable/detachable top section being removed/detached according to an aspect of an embodiment of the present invention.
Figure 17:
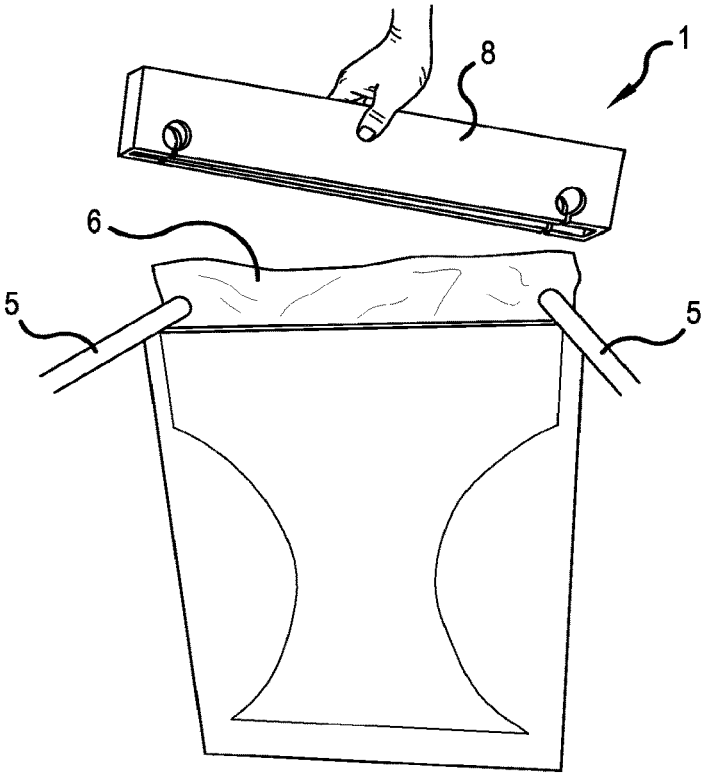
FIG. 17 illustrates a view showing a trash bag apparatus mounted on a trash bag receptacle showing its removable/detachable top section having been fully removed/detached according to an aspect of an embodiment of the present invention.

Referring now to FIGS. 15-17 views showing removable or detachable top section 8 of trash bag apparatus 1 are shown according to aspect(s) of embodiment(s) of the present invention. Apparatus 1 may have top removable, detachable and/or perforated section 8 which enables access to holes 2A-D directly. Access to bag(s) 6 may also be enabled by removal of detachable top section 8. In one aspect of an embodiment of the present invention, section 8 may be connected with a removable or detachable front panel 3 which may enable access to deploy bag(s) 6. In another aspect of an embodiment of the present invention, apparatus 1 may have just have one opening in total in the front of apparatus 1 which allows access to both holes 6A & 6B of bag(s) 6 in order to hang and provide access to bag(s) 6 in which case, bag(s) 6 may be able to be deployed faster and easier from apparatus 1 with the user having removed an entire large section of the apparatus all at one time which will allow someone access to the holes and to deploy the bags all at once by simply removing one section only. This large piece can be removed by the manufacturer or the user when ready to use.

In one aspect of an embodiment of the present invention, removable or detachable top section 8 may include of detachable and non-detachable sections, where the non-detachable section enables the apparatus to remain mounted on the bars/rods after the detachable section of top section 8 has been detached.

Figure 18:
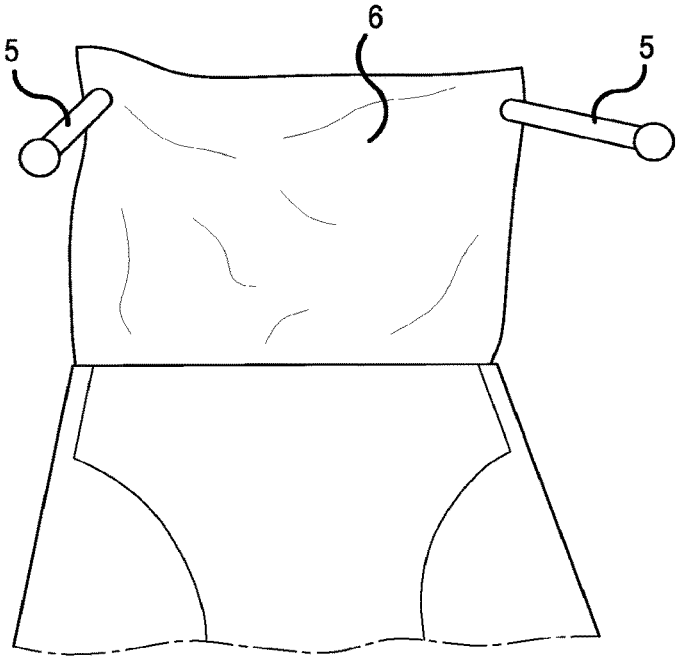
FIGS. 18 & 19 illustrate views showing a trash bag mounted on a trash bag receptacle and being distanced or removed from inside a trash bag apparatus according to aspects of embodiments of the present invention.
Figure 19:
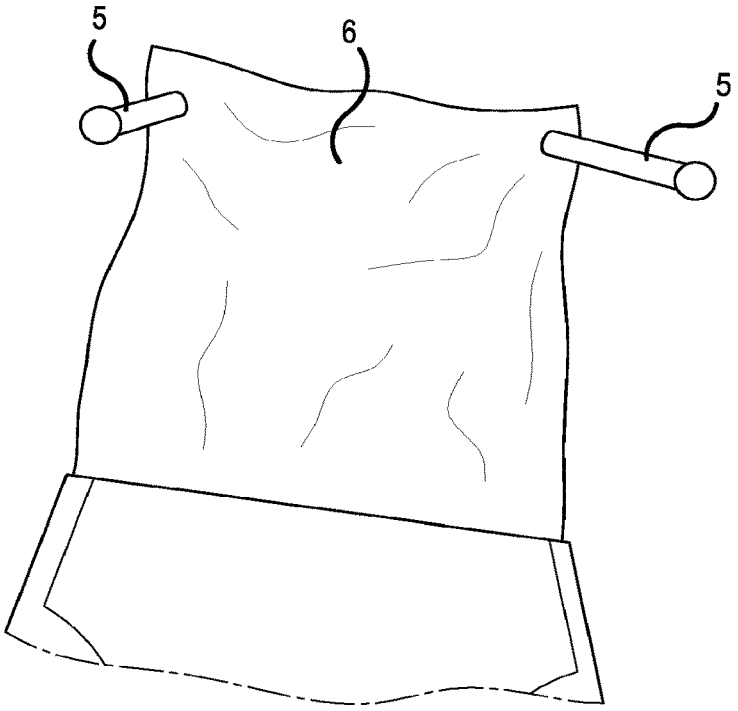
Figure 20:
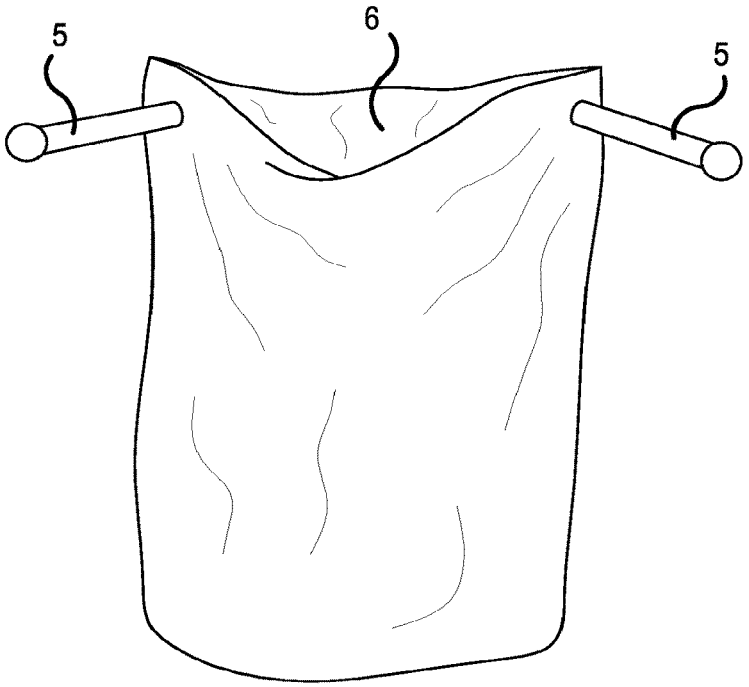
FIG. 20 illustrates a view showing a trash bag mounted on a trash bag receptacle without a trash bag apparatus according to an aspect of an embodiment of the present invention.

Referring now to FIGS. 18-20, views showing removal of detachable top section 8 & the remaining section of apparatus 1 are shown according to aspect(s) of embodiment(s) of the present invention. With the removal of detachable top section 8, a user can still keep the remaining section of apparatus 1 to retain control of bag flow from apparatus 1. In another aspect of an embodiment of the present invention, the remaining section of apparatus 1 may be removed for full bag exposure as shown in FIGS. 18-20 thereby resulting in full exposure of bag(s) 6 as shown in FIG. 20.

Figure 21:
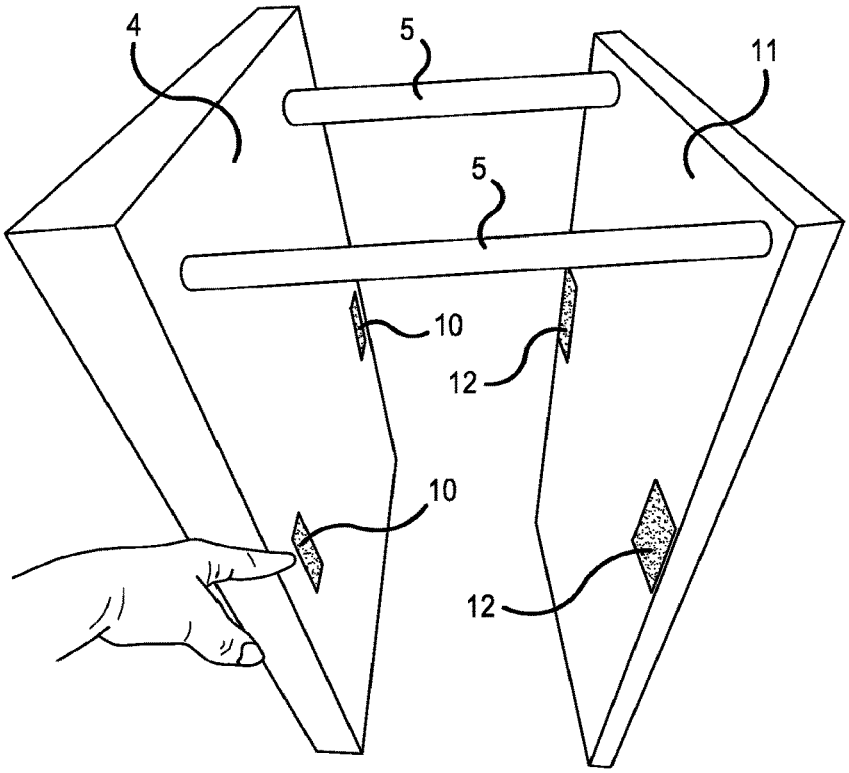
FIG. 21 illustrates a view showing a trash bag apparatus with attachment mechanism(s) according to an aspect of an embodiment of the present invention.

Referring now to FIG. 21, a view showing trash bag apparatus 1 with attachment mechanism(s) 10 is shown according to an aspect of an embodiment of the present invention. Attachment mechanism(s) 10 of apparatus 1 may be configured to connect and secure to trash receptacle 11 to ensure apparatus 1 remains in position. Attachment mechanism(s) 10 may be, without limitation, any one of: hook and loop, hook, adhesive, lock, clips. Attachment mechanism(s) 10, in another aspect of an embodiment of the present invention, may cooperatively lock with corresponding mechanism(s) 12 on trash receptacle 11 in order to secure apparatus 1 in position.

Figure 22:
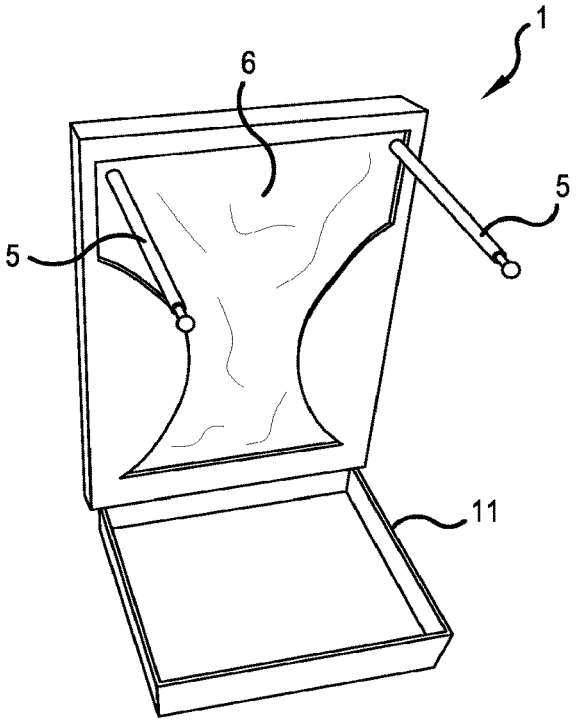
FIG. 22 illustrates a view showing a trash bag apparatus mounted on a trash bag receptacle showing its removable/detachable front section having been fully removed/detached according to an aspect of an embodiment of the present invention.
Figure 23:
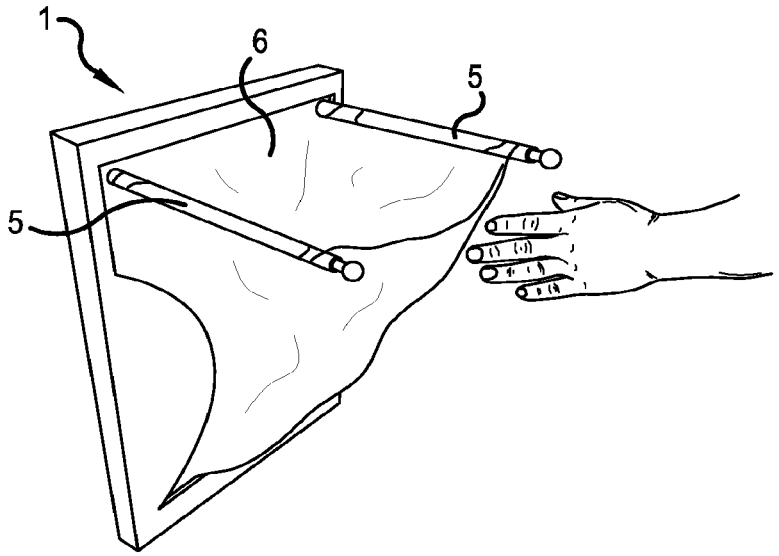
FIG. 23 illustrates a view showing a user about to dispense a trash bag from a trash bag apparatus mounted on a trash bag receptacle according to an aspect of an embodiment of the present invention.
Figure 24:
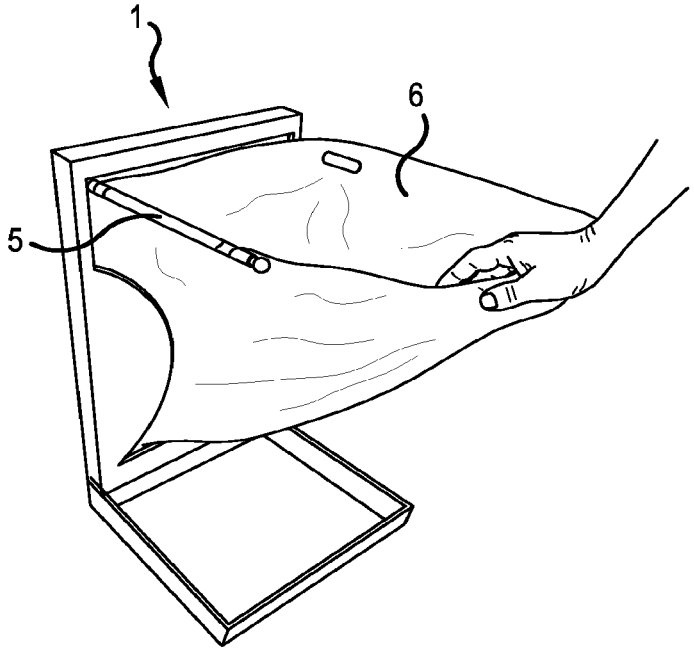
FIG. 24 illustrates a view showing a user dispensing a trash bag from a trash bag apparatus mounted on a trash bag receptacle according to an aspect of an embodiment of the present invention.
Figure 25:
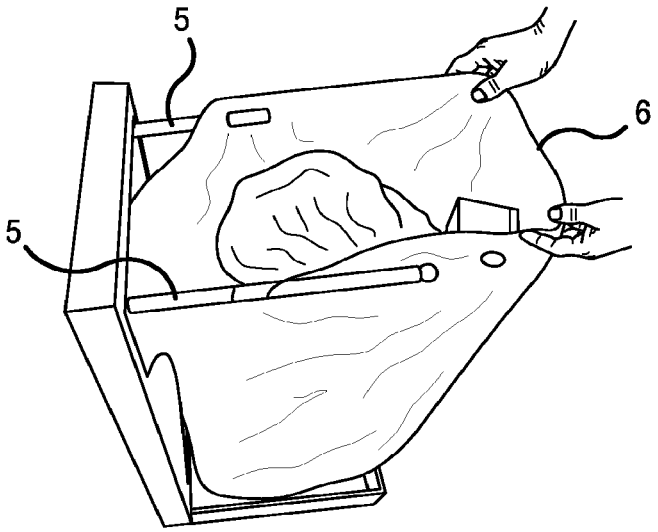
FIG. 25 illustrates a view showing a user removing a full trash bag from a trash bag receptacle according to an aspect of an embodiment of the present invention.

Referring now to FIG. 22, a view showing trash bag apparatus 1 mounted on trash bag receptacle 11 showing removable or detachable front section 3A having been fully detached is shown according to an aspect of an embodiment of the present invention. In one aspect of an embodiment of the present invention, apparatus 1, by its installation on bars/rods 5 of a trash receptacle, may not touch the base of trash receptacle 11 as it would hang above the base of trash receptacle 11 thereby avoiding contact with potential spills etc. that may occur.

Figure 26:
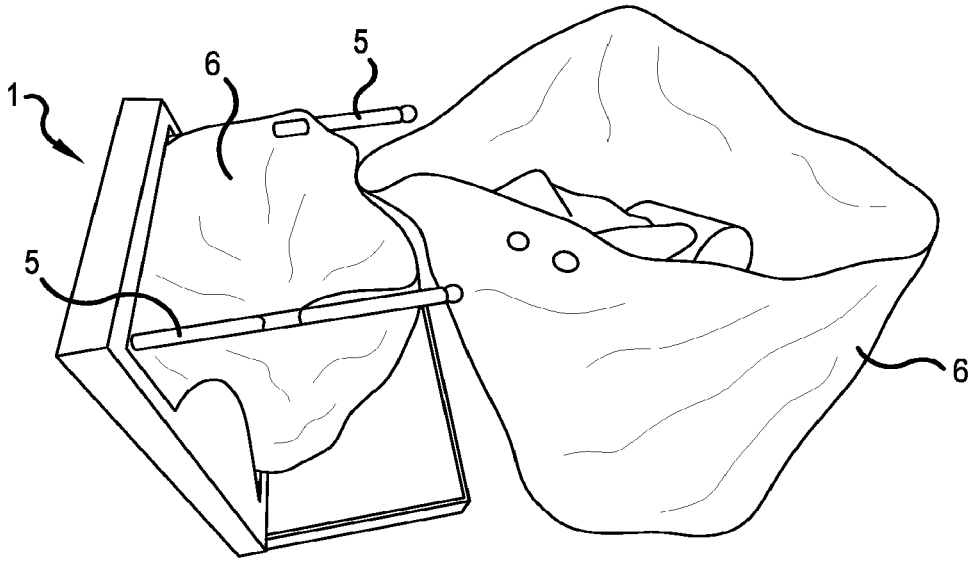
FIGS. 26-28 illustrate views showing removed trash bags next to a trash bag receptacle and a mounted trash bag apparatus according to aspects of embodiments of the present invention.
Figure 27:
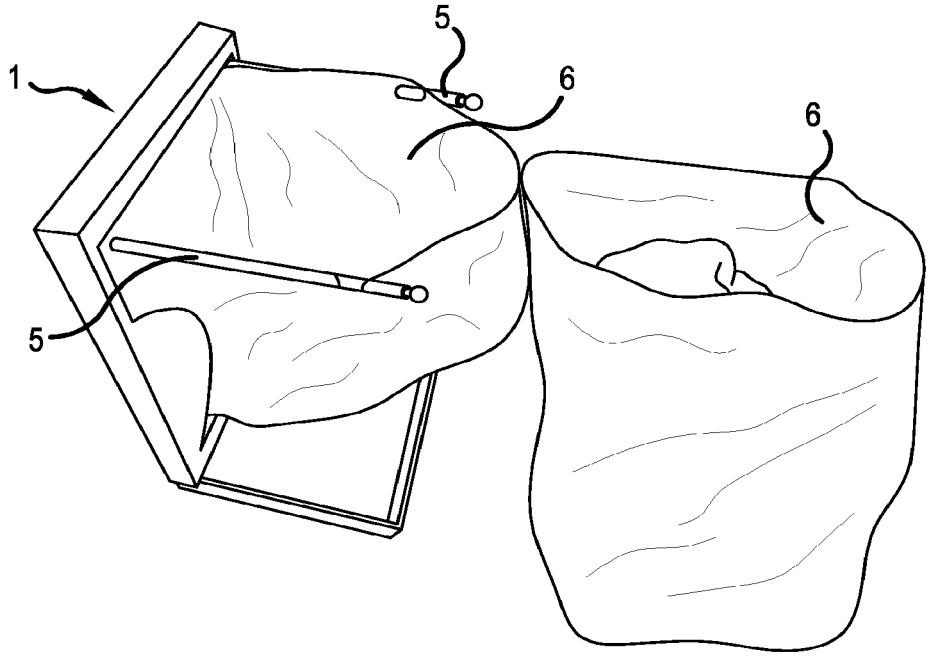
Figure 28:
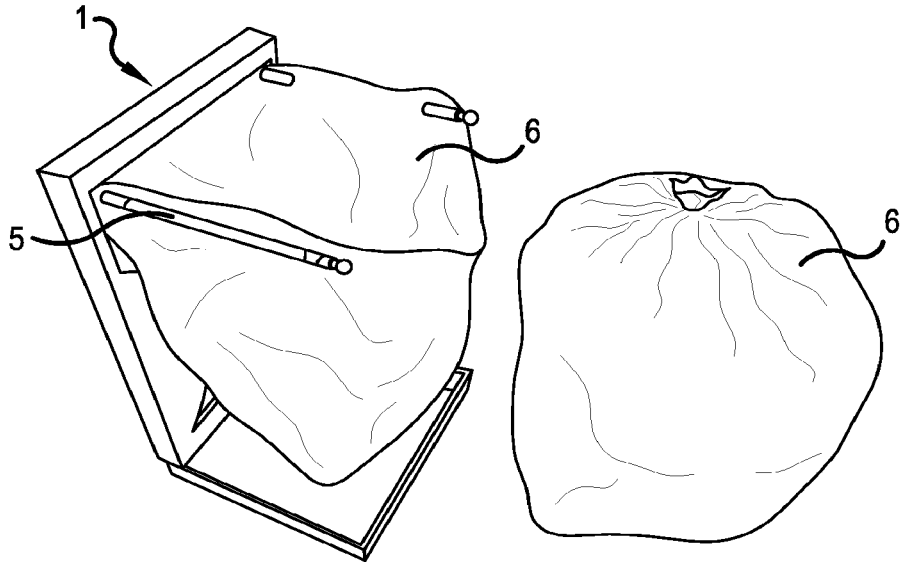

Referring now to FIGS. 23-28, views showing progressional deployment of bag 6 from apparatus 1 are shown according to aspect(s) of embodiment(s) of the present invention. Apparatus 1, having been mounted onto bars/rods 5 of trash receptacle 11, enable deployment of bag 6 through removed/detached section 3*a* of apparatus 1. This configuration enables deployment of bag 6 as shown and subsequent deployment of the next bag from apparatus 1. Apparatus 1, by way of its installation and use of its removable and/or perforated portions, enable release of only one bag 6 as a used bag is pulled away (FIGS. 26-28).

The invention has been described in detail with particular reference to certain preferred embodiments thereof, but it will be understood that variations and modifications can be effected within the spirit and scope of the invention.

What is claimed is:

1. An apparatus for dispensing at least one bag positioned therein, comprising:

a front panel and a rear panel that form an enclosure, the front panel having at least one front panel opening, at least one bag disposed within the enclosure between the front and rear panels in a storage position and comprising more than one mounting hole, wherein the rear panel further comprises at least one rear panel hole, and at least two bag support rods, wherein the at least two bag support rods extend through the at least one rear panel hole, through a at least one of the more than one mounting hole of the at least one bag, and through the at least one front panel opening thereby enabling the at least one bag to be dispensed from the at least one front panel opening while simultaneously moving along the at least two bag support rods from within the enclosure.

* * * * *